United States Patent [19]

Yoda

[11] 3,969,886

[45] July 20, 1976

[54] DIGITAL ELECTRONIC WATCH FOR DISPLAYING BOTH TIME AND THE TIME REMAINING WITHIN A PRESELECTED TIME PERIOD

[75] Inventor: Kazuhiro Yoda, Komae, Japan

[73] Assignee: Kabushiki Kaisha Daini Seikosha, Japan

[22] Filed: Oct. 21, 1974

[21] Appl. No.: 516,731

Related U.S. Application Data

[63] Continuation of Ser. No. 276,651, July 31, 1972, abandoned.

[30] Foreign Application Priority Data

June 30, 1971 Japan ..... 46-57300

[52] U.S. Cl. ..... 58/23 R; 58/21.13; 58/127 R

[51] Int. Cl.[2] ..... G04C 3/00

[58] Field of Search ..... 58/23 R, 50 R, 4 A, 58/127 R, 125 R, 126 R, 39.5, 153, 21.13, 58

[56] References Cited

UNITED STATES PATENTS

| | | | |
|---|---|---|---|
| 2,932,779 | 4/1960 | Tancig | 58/39.5 |
| 3,610,753 | 10/1971 | Neuhauer | 58/21.13 X |
| 3,646,751 | 3/1972 | Purland et al. | 58/152 R |
| 3,662,535 | 5/1972 | Hedrick et al. | 58/127 R X |
| 3,664,116 | 5/1972 | Emerson et al. | 58/50 R X |
| 3,738,099 | 6/1973 | Tanaka | 58/50 R X |
| 3,795,099 | 3/1974 | Tsuruishi | 58/23 R |
| 3,797,222 | 3/1974 | Kato | 58/4 A |

*Primary Examiner*—Ulysses Weldon
*Attorney, Agent, or Firm*—Robert E. Burns; Emmanuel J. Lobato; Bruce L. Adams

[57] ABSTRACT

A digital electronic watch has a time display section for displaying in digital form the time in minutes and hours and a remaining-time display section for displaying the time remaining within one of several different preselected time periods. The remaining-time display section includes a series of liquid crystal panels capable of being turned ON and OFF, and an electric circuit is provided for sequentially energizing or deenergizing the panels at predetermined time intervals to progressively turn ON or OFF the liquid crystal panels whereby the panels collectively provide a shining or brightness indication of the time remaining within the selected time period. A manual switch is provided to manually set the desired time period whose remaining duration is to be displayed and an audible alarm signal is emitted in response to the expiration of a predetermined portion of the selected time period.

13 Claims, 7 Drawing Figures

DIGITAL ELECTRONIC WATCH FOR DISPLAYING BOTH TIME AND THE TIME REMAINING WITHIN A PRESELECTED TIME PERIOD

This is a continuation, of application Ser. No. 276,651, filed July 31, 1972 ]now abandoned.

The present invention relates to a digital electronic watch and more particularly to a digital electronic watch which displays the time in digital form and which also displays the time remaining before the expiration of a preset time period.

Many types of mechanical watches and electronic watches are available for indicating the time in various forms but these watches are not equipped to display the amount of time remaining before the elapsing of a preset time period. There are numerous instances when a person wants to know how much time remains before the expiration of a certain time interval, for example, students taking timed examinations frequently wish to know how much time remains within the examination period; businessmen oftentimes make appointments and would like to know the time remaining before their appointment; and housewives have many occasions where they wish to know when a certain time period has elapsed, such as during cooking, adhering to a schedule of activities, etc.

Unfortunately, the prior art watches do not provide any type of remaining-time display device for visibly displaying the amount of time remaining within a preselected time period. As a result, conventional watches are useful only as timepieces and do not automatically inform the wearer of the time remaining within a preselected time period.

It is therefore a primary object of the present invention to provide a watch having a remaining-time display device for displaying the time remaining from the instant the device is turned ON to the expiration of a time period set into the device.

It is another object of the present invention to provide a digital electronic watch having a time display device for displaying the time in digital form and a remaining-time display device for displaying the time remaining within a preselected time period.

It is a further object of the present invention to provide a digital electronic watch having a remaining-time display device including an alarm for providing an audible warning signal signifying the expiration of a predetermined portion of the time period being displayed by the remaining-time display device.

It is yet another object of the present invention to provide a digital electronic watch having a remaining-time display device which may be manually set to display a wide range of different time periods thereby increasing the diversity of purposes to which the watch may be put.

It is still another object of the present invention to provide a digital electronic watch having a time display device for displaying the time remaining within a predetermined period and which is smart in appearance strong in construction and reliable in operation.

The above and other objects of the present invention are carried out by a digital electronic watch having a time display section for displaying the time in digital form, a remaining-time display section composed of a column of liquid crystal display panels, remaining-time display circuitry for sequentially and progressively energizing the display panels at preselected time intervals to sequentially turn the display panels ON or OFF thereby providing an indication of the time remaining in the preselected time period, a manually operable switch switchable to a series of different positions to accordingly select a series of time periods having different durations which are to be displayed by the remaining-time display device, and a time unit scale juxtaposed along the column of liquid crystal panels for displaying the time periods selected by the switch thereby enabling a person to glance quickly at the scale and determine from the number of liquid crystal panels which are energized the approximate amount of time remaining in the preselected time period. A warning device provides an audible warning signal whenever the remaining time decrease to a certain value.

Having in mind the above and other objects that will be evident from an understanding of this disclosure, the present invention comprises the combination and arrangements of parts as illustrated in the presently preferred embodiments of the invention which are hereinafter set forth in sufficient detail to enable those persons skilled in the art to clearly understand the function, operation, construction and advantages of it when read in conjunction with the accompanying drawings and wherein.

Figure 1:
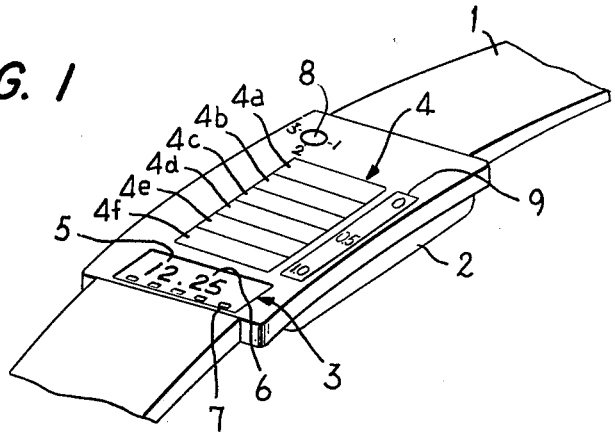
FIG. 1 is a perspective and schematic view of a digital electronic watch constructed in accordance with the present invention.

One embodiment of the digital electronic watch according to the present invention is shown in FIG. 1 and comprises a watch band 1 connected to a watch casing 2 in a conventional manner to form a wrist watch. The watch casing 2 includes a time display section 3 for displaying the time in digital form and a remaining-time display section 4 for displaying the time remaining within a certain time period preselected by the wearer of the watch The time display section 3 is of conventional construction and includes an "hour" display section 5 and a "minute" display section 6 for displaying in digital form the time in hours and minutes and the display sections comprise a series of liquid crystal display segments. A "second" display section 7 comprises five liquid crystal segments disposed in a row beneath the hour and minute display sections to display the time in seconds. A time display device developes suitable signals for controlling the operation of the time display section 3 and will be described in detail hereinafter.

The remaining-time display section 4 comprises six liquid crystal display panels or members 4*a*–4*f* each having a rectangular shape and arranged in a column one atop the other. All of the liquid crystal panels are of conventional construction and have certain optical properties, such as reflectivity, which vary when the liquid crystal material is electrically energized so as to provide a shining light output as compared to the non-shining output when the panels are non-energized. For example, when non-energized, the liquid crystal panels assume a transparent state and provide no shining output whereas when energized, the panels assume a cloudy or milky white state due to light scattering and exhibit a shining output.

A manually-actuated time-setting switch 8 is turnably mounted on the front face of the watch casing and the switch 8 is turnable to one of three working positions in the embodiment shown. The switch 8 is connected to suitable circuitry to a remaining-time display device which will be hereinafter described and sets the desired time period or time unit whose remaining duration is to be displayed by the remaining-time display section 4. The setting of the switch 8 also turns ON the remaining-time display device to initiate the running of the time period. The remaining-time display section 4 then displays the amount of time remaining within the time unit determined by the setting of the switch 8.

For example, when the time-setting switch 8 is moved into position 1, the remaining-time display device is placed in a one-hour mode and all the display panels are initially energized and turned ON and the display panels 4*f*–4*a* are then individually and sequentially deenergized and turned OFF at 10-minute intervals to collectively provide a visible indication of the time remaining before the expiration of the one-hour time until set by the switch 8. When the time-setting switch 8 is moved to position 2, the remaining-time display device is shifted into a 2-hour mode and the individual liquid crystal panels 4*f*–4*a* are sequentially deenergized at 20-minute intervals and in a similar manner when the time-setting switch 8 is moved to position 3, the remaining-time display device is shifted to a 4-hour mode wherein the liquid crystal panels 4*f*–4*a* are sequentially and successively deenergized at 40-minute intervals.

A time unit display section 9 is positioned along the column of liquid crystal panels 4*a*–4*f* for displaying a time scale of the time unit set by the time-setting switch 8. The time unit display section 9 has three different time scales each corresponding to one of the time units selected by the time-setting switch 8 and each scale is calibrated in hours. The scale depicted in FIG. 1 corresponds to the one-hour mode of the remaining time display device corresponding to the positioning of the switch 8 in position 1. The time unit display section 9 indicates the mode setting of the switch 8 and also provides a time reference axis to facilitate the reading of the remaining-time display section 4.

The one-hour time scale comprises a 0 marking adjacent the liquid crystal panel 4*a* and a 1.0 hour marking adjacent the liquid crystal panel 4*f* indicating that the remaining-time display device is in the 1-hour mode thus indicating to the user that the individual liquid crystal panels 4*f*–4*a* will sequentially be turned off at 10-minute intervals starting with the liquid crystal panel 4*f* and progressing successively to the panel 4*a*. The scale also includes a 0.5 hour marking midway between the 0 and 1.0 hour markings signifying that only one-half hour remains before the expiration of the one hour time unit selected by the time-setting switch 8. In a similar manner, the time unit display section 9 includes a 2-hour time scale having 0, 1.0, 2.0 hour markings corresponding to the 2-hour mode and a 4-hour time scale having 0, 2.0, 4.0 hour markings corresponding to the 4-hour mode.

Figure 2:
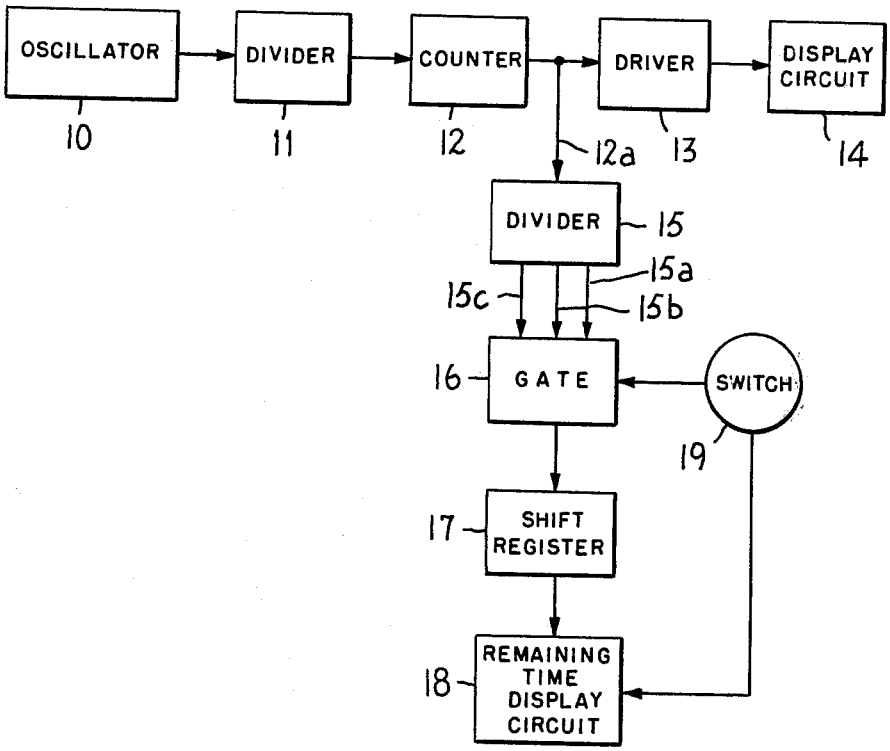
FIG. 2 is a schematic block diagram of the electronic circuits employed in the digital electronic watch.

The circuitry of the time display device and the remaining-time display device for effecting the various operations described above is shown in FIGS. 2 and 3. A crystal oscillator 10 generates a series of pulses at a high frequency which serve as a time base and delivers the pulses to a divider 11 which divides the pulses into a one-second signal having a frequency of one pulse per second. The 1 second signal output form the divider 11 is fed into a counter 12 which counts the pulses and at suitable intervals, delivers the counted pulses as a timing pulse signal to a time display device composed of a driver circuit 13 which receives the signal and drives a display circuit 14 which displays the time in digital form on the time display section 3.

The timing pulse signal is also fed from the counter 12 along a line 12*a* to the remaining-time display device which has a divider circuit 15 having three output lines 15*a*, 15*b* and 15*c*. The divider circuit 15 divides the timing pulse signal into three different time signals each representative of one of the time settings selected by a time-setting switch 19 which corresponds to the switch 8 in FIG. 1. The three time signals are fed to a gate circuit 16 and one of them is then applied to a shift register 17 for controlling the operation of a remaining-time display circuit 18 which displays the time remaining on the remaining-time display section 4. Thus the setting of the switch 19 determines which of the time signals will be applied to the shift register 17 to control the energization periods of the individual liquid crystal panels which constitutes the remaining-time display section.

The gate circuit 16, shift register 17 and remaining-time display circuit 18 jointly comprise electric circuit means which receive the three time signals and effect energization of the remaining-time display section 4 in the proper mode as selected by the switch 19.

Figure 3:
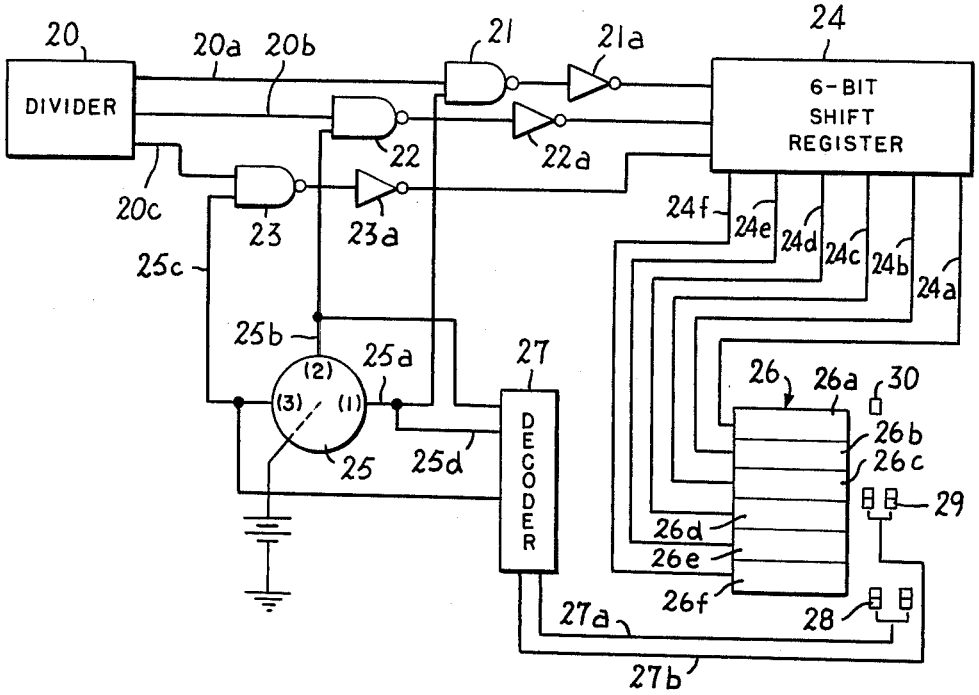
FIG. 3 is a block diagram of one embodiment of the electronic circuits for energizing the remaining-time display device shown in FIG. 2.

The details of one embodiment of a remaining-time display device are shown in FIG. 3. A divider circuit 20 corresponding to the divider circuit 15 in FIG. 2 receives a counted pulse signal from a counter and divides the pulse signal into a 10-minute signal having a frequency of one pulse per 10 minutes which is applied to an output line 20*a*, a 20-minute signal having a frequency of one pulse every 20 minutes which is applied to an output line 20*b*, and a 40-minute signal having a frequency of one pulse per 40 minutes which is applied to an output line 20*c*. Each of the minute signals is applied to a 6-bit shift register 24 through a logic circuit composed of NAND and NOT gates. The output line 20*a* is connected to a NAND gate 21 which has an output connected to a NOT gate 21*a* having an output connected to the shift register 24. In a like manner, the output line 20*b* is connected through a NAND gate 22 and a NOT gate 22*a* to the shift register 24 whereas the output line 20*b* is connected through a NAND gate 23 and a NOT gate 23*a* to the shift register.

The 6-bit shift register 24 has six output lines 24*a*–24*f* connected respectively to liquid crystal panels 26*a*–26*f* of a remaining-time display section 26. A time-setting switch 26 corresponding to the switch 8 in FIG. 1 has three working positions and an output line 25*a* connects the switch 25 to the NAND gate 21 when the switch is in position 1, an output line 25*b* connects the switch 25 to the NAND gate 22 when the switch is in position 2, and an output line 25*c* connects the switch 25 to the NAND gate 23 when the switch is in the position 3. The output lines from the switch 25 are also connected to a decoder 27 and an output line 27*a* connects the decoder 27 to a pair of liquid crystal elements 28 and an output line 27*b* connects the decoder 27 to a pair of liquid crystal elements 29.

The liquid crystal elements 28 are positioned at one end of the remaining-time display section 26, the liquid crystal elements 29 are positioned at the middle of the section 26 and another liquid crystal element 30 is positioned at the other end of the section 26. The elements 28, 29 and 30 function in a manner similar to the time unit display section 9 in FIG. 1 and visually portray the time unit selected by the switch 25. The element 30 always displays a 0 and the pair of elements 29 alternatively disclose 0.5, 1.0 and 2.0 denoting one-half hour, 1 hour and 2 hours respectively of the time remaining and the pair of elements 28 alternatively display the numbers 1.0 and 2.0, 4.0 indicating that 1, 2 or 4 hours is the time unit selected by the switch 25.

Assuming that the switch 25 is turned ON to the position 1, signals are generated on the register output lines 24*a*–24*f* to energize and turn ON the liquid crystal panels 26*a*–26*f*. Position 1 corresponds to the one-hour time unit setting and thus the panels 26*f*–26*a* will be sequentially turned OFF at 10 minute intervals. As soon as 10 minutes have elapsed from the positioning of the switch to position 1, the voltage applied to the shift register 24 through the NOT circuit 21*a* is no longer transmitted to the line 24*f* whereupon the liquid crystal panel 26*f* is turned OFF. The panels 26*e*–26*a* are sequentially and progressively turned OFF in this fashion at 10 minute intervals thereby providing a visual display of the remaining time.

When the switch 25 is turned ON to position 1, voltage is applied through a line 25*d* to the decoder 27 causing suitable voltages to be generated on the lines 27*a* and 27*b* to drive the pair of elements 28 to display the number 1.0 and to drive the pair of elements 29 to display the number 0.5 and as aforementioned, the element 30 is always driven to display 0. The time unit display elements 28 – 30 thus indicate that the remaining-time display section 26 is operating in the 1-hour mode and therefore each individual panel will be deenergized at ten minute intervals until 1 hour has elapsed.

In the embodiment of FIG. 3, the time remaining is displayed by progressively and sequentially turning OFF the liquid panels 26*f*–26*a* at 10 minute intervals. Of course, it is understood that the liquid crystal panels 26*f*–26*a* may be sequentially turned ON at 10 minute intervals to portray the elapsing time and by this arrangement the time remaining within the preselected time unit will be displayed as a progressively decreasing number of darkened panels rather than a progressively decreasing number of lighted panels.

When the time-setting switch 25 is set in the position 2, the aforementioned mode of operation is repeated except in this instance, the time reference scales 28 – 30 display respectively 2.0, 1.0 and 0 indicating that a 2-hour time unit has been selected and the liquid crystal panels are sequentially turned OFF by the register 24 at 20-minute intervals. In a similar manner, when the switch 25 is set to the position 3, the scales 28 and 29 respectively display the hour markings 4.0 and 2.0 signifying that a 4-hour time unit has been selected and the individual liquid crystal panels are turned OFF at 40-minute intervals.

The periodic energization or deenergization of the liquid crystal display panels at predetermined time intervals provides a visual indication of the remaining time in digital form which may be easily viewed by the wearer of the watch. Though the display panels do not display numbers, they do display the remaining time in discrete units and in this sense, they display information in digital form.

Figure 4:
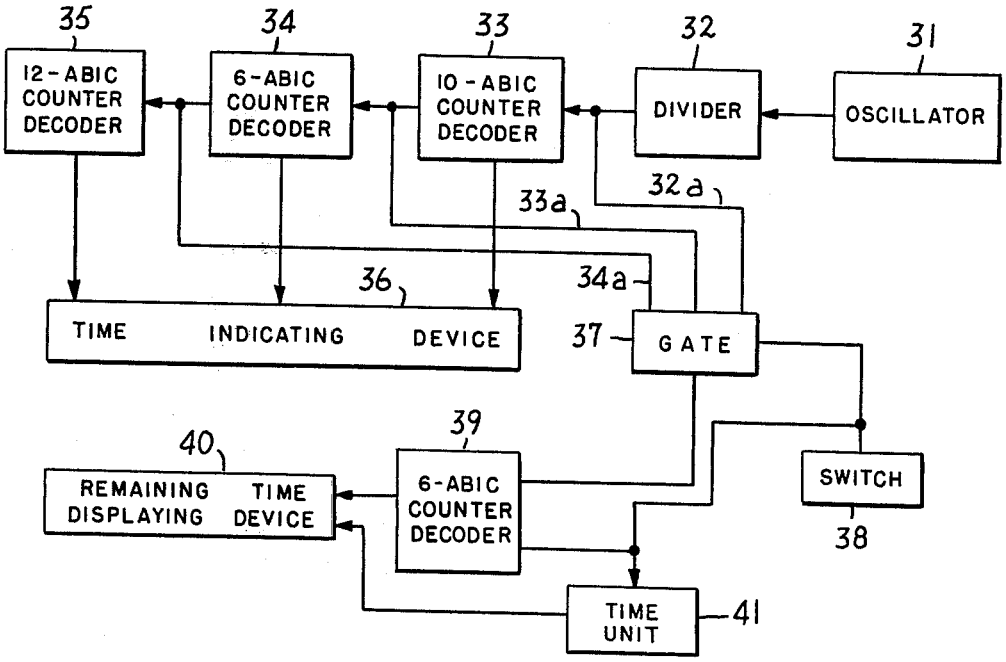
FIG. 4 is a block diagram of another embodiment of electronic circuits for energizing another type of remaining-time display device.
Figure 5:
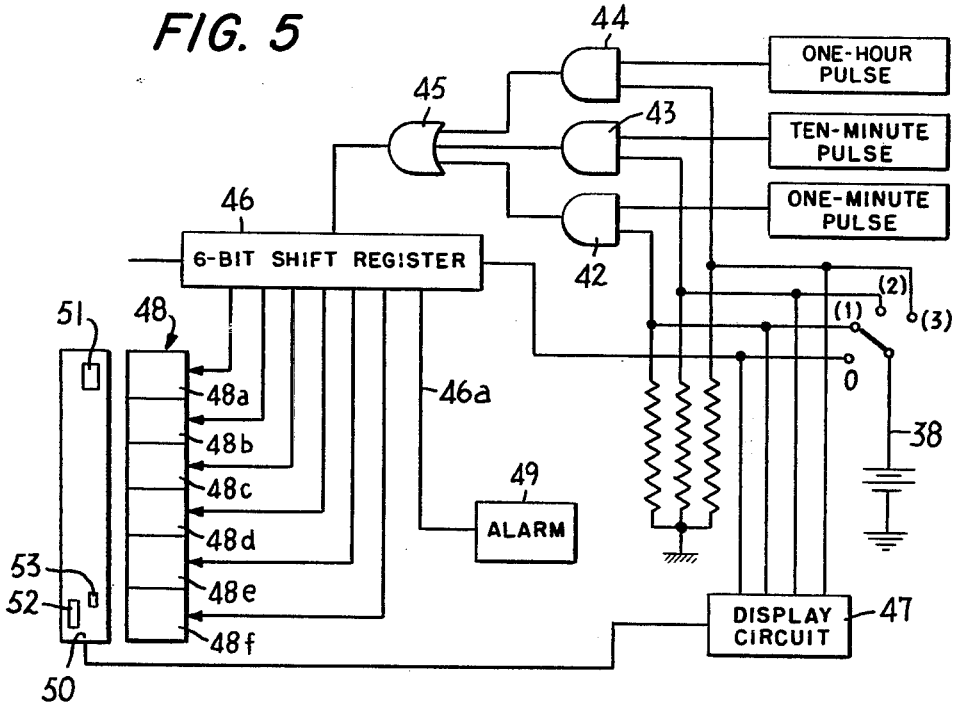
FIG. 5 is a block diagram of several of the components shown in FIG. 4.

Another embodiment of the digital electronic watch according to the present invention is shown in FIGS. 4 and 5 and in this embodiment, an alarm device is included to provide an alarm signal after the expiration of a preselected portion of the time set by the time-setting switch. As seen in FIG. 4, a standard oscillator 31 generates pulses at a preselected frequency which serve as a time base and delivers the pulses to a divider 32 which divides the pulses into a 1-minute signal having a frequency of one pulse per minute. The 1-minute signal is applied to a 10-abic counter decoder 33 and to a gate 37 along a line 32*a*. The 10-abic counter decoder 33 sums up ten of the 1-minute signals and produces a 10-minute signal having a frequency of one pulse every 10 minutes and applies this signal to a 6-abic counter decoder 34 and to the gate 37 along a line 33*a*. In a similar manner, the 6-abic counter decoder 34 counts six of the 10-minute pulses and developes a 1-hour pulse having a frequency of one pulse per hour and applies this signal to a 12-abic counter decoder 35 as well as to the gate 37 along the line 34*a*.

Each of the counter decoder circuits 33–35 comprises an n-abic counter combined with a decoder. The n-abic counters is obtained by connecting the flip-flop circuits in cascade with suitable feed-back and an example of such circuitry is found in the RCA COS/MOS Integrated Circuit Manual published in March of 1971 in the chapter entitled "Counters and Registers", pages 70 to 108. Each of the counter decoder circuits is also connected to a time indicating device 36 which displays the time in minutes and hours in digital form as known in the art.

The gate 37 receives a one-minute signal, a 10-minute signal and a 1-hour signal and the particular signal to be gated by the gate 37 is determined by the position of a manually turnable switch 38. The gate is connected to another 6-abic counter decoder 39 which is connected to a remaining-time display device 40 for displaying the time remaining in accordance with the time unit selected by the switch 38. A time unit displaying circuit 41 is connected to the switch 38 and to the remaining-time displaying device 40 and functions to change the time scale in the remaining-time displaying device in accordance with the position of the switch 38.

The gate circuit 37, the switch 38 and the time unit displaying circuit 41 are shown in more detail in FIG. 5. An AND gate 42 receives the one-minute signal, an AND gate 43 receives the 10-minute signal, and an AND gate 44 receives the 1-hour signal, it being understood that these signals originate from the divider 32. The switch 38 has four setting positions comprising a position 0 wherein the movable switch contact is connected to a 6-bit shift register 46 and a time unit displaying circuit 47, a position 1 wherein the movable switch contact is connected to the AND gate circuit 42 and the time unit displaying circuit 47, a position 2 wherein the movable switch contact is connected to the AND gate circuit 43 and the time unit displaying circuit 47, and a position 3 wherein the movable switch contact is connected to the AND circuit 44 and the time unit displaying circuit 47.

In order to reset the remaining-time display device, the switch 38 is moved to the position 0 and a signal having a predetermined voltage is applied through the movable switch contact to the 6-bit register 46 to reset the register 46 and therefore the remaining-time display device. When the switch 38 is set to position 1, a signal is applied to one of the two inputs of the AND gate 42 and therefore the 1-minute pulse signal applied to the other input passes through the open gate and through an OR circuit 45 to the shift register 46. In a like manner, when the switch is set to the position 2 or 3, the AND gate 43 or 44 is respectively energized and accordingly passes therethrough the 10-minute signal or the 1-hour signal.

A remaining-time display section 48 includes six liquid crystal segments 48*a*–48*f* and each of these segments or panels is connected to an output of the shift register 46. An alarm device 49, such as a bell or buzzer, is connected to the end output of the shift register 46 by a line 46*a* and the alarm device sounds an audible alarm when the time unit selected by the switch 38 has expired. It is understood that the alarm device may be connected to other outputs of the register 46 to provide an appropriate alarm signal at times other than at the end of the time unit and for example, the alarm could sound at the midway point of the time unit or at any other desired time.

The time unit display device 50 is connected to the time unit displaying circuit 47 and provides a visible indication of the particular time unit selected by the switch 38. The time unit display device 50 includes a display section 51 located adjacent the liquid crystal panel 48*a* and this display section always displays 0, a display section 52 adjacent the liquid crystal panel 48*f* for displaying the particular time unit selected by the switch 38, and a display section 53 positioned at the upper right side of the display section 53 for displaying either a minute or hour symbol.

Figure 6:
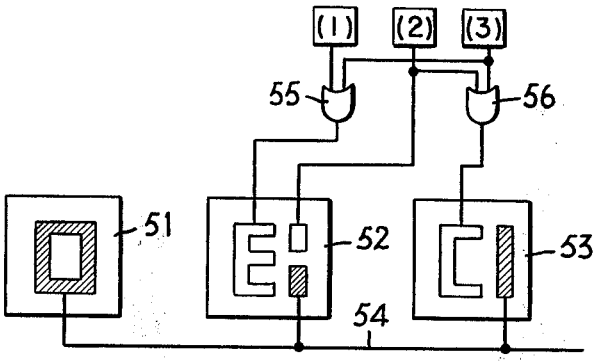
FIG. 6 is a schematic representation of a portion of the remainingtime display device shown in FIG. 5.

FIG. 6 is a schematic representation of an embodiment of the display sections 51, 52 and 53. Each display section comprises a support member having thereon a display element such as a liquid crystal element which becomes milkly white and placed in its shining state when suitably energized with electrical energy. The display element of the display section 51 is in the form of a 0 since this is the only symbol displayed by the display section 51. The display section 52 includes three distinct liquid crystal elements comprising an E-shaped element and upper and lower vertical elements arranged as shown and the three elements may be selectively energized to from either the number 1 or the number 6. The display section 53 includes two liquid crystal elements comprising a C-shaped element and an I-shaped element which may be selectively energized to form either a"°" or a "′" denoting either an hour symbol or a minute symbol. The display sections have not been shown to scale in FIG. 6 but have been shown in enlarged form to facilitate their understanding.

A common lead line 54 is connected to a voltage source at one end and to individual ones of the display elements in each of the display sections as shown in FIG. 6. The particular display elements connected to the line 54 are always energized during use of the remaining-time display device whereas the remaining display elements in the display sections 52 and 53 are selectively energized in dependence upon the position of the time-setting switch 38. When the switch 38 is in position 1, voltage is applied through an OR gate 55 to the E-shaped display element of the display section 52 and thus this element is energized along with the element energized by the line 54 to form the number 6. At the same time, the display section 53 has only the I-shaped element energized denoting the minute symbol ′.

Figure 7:
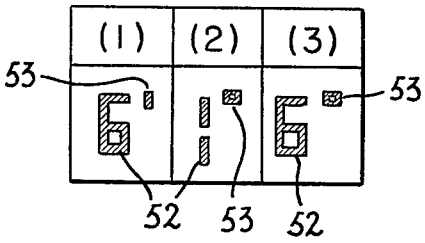
FIG. 7 is a chart showing the various possible states of the time units display sections disclosed in FIG. 6.

When the switch 38 is in position 2, the E-shaped display element of the display section 52 is not energized and instead, the upper vertical element is energized and this forms along with the lower vertical element energized by the line 54, the number 1. At the same time, voltage is applied through an OR gate 56 to the C-shaped display element of the display section 53 which coacts with the vertical I-shaped display element to form the symbol ° denoting hours. When the switch 38 is in position 3, the E-shaped display element of the display section 52 is again energized and coacts with the lower vertical element to form the number 6 while the C-shaped display element of the display section 53 is energized coincidently with the I-shaped display element to form the symbol ° denoting hours. FIG. 7 is a chart showing the numbers and symbols present on the display sections 52 and 53 for the three positions of the time-setting switch 38. Other display elements aside from liquid crystals may be employed in practicing the present invention, such as light-emitting diodes.

The invention has been described in conjunction with preferred embodiments and it is to be understood that obvious modifications and changes may be made without departing from the spirit and scope of the invention as defined in the appended claims.

What I claim is:

1. In a digital electronic watch: means for generating an electric timing pulse signal having a sufficient pulse repetition rate to be used as a time reference; solid-state time display means receptive of and responsive to said electric timing pulse signal for displaying the time in minutes and hours in digital form; solid-state remaining-time display means receptive of and responsive to said electric timing pulse signal and operative when turned ON for displaying information representative of the time remaining within at least one preselected time period in discrete digital form; and a single manually-actuated switching means coacting with said solid-state remaining-time display means for manually switching ON said remaining-time display means to initiate the running of said time period.

2. A digital electronic watch according to claim 1; wherein said remaining-time display means includes means for displaying information representative of said time remaining in digital form.

3. A digital electronic watch according to claim 1; wherein said remaining-time display means comprises a series of energizeable members each operative when energized to provide a shining output, and means receptive of said timing pulse signal for sequentially energizing said energizeable members at predetermined time intervals to obtain a progression of shining outputs which collectively provide a visible indication of the time remaining within said preselected time period.

4. A digital electronic watch according to claim 1; wherein said remaining-time display means comprises a series of energizeable members each operative when energized to provide a shining output, means for effecting simultaneous energization of all said energizeable members in response to switching ON said remaining-time display means, and means receptive of said timing pulse signal for then sequentially deenergizing said energizeable members at predetermined time intervals to obtain a progression of nonshining outputs which collectively provide a visible indication of the time remaining within said preselected time period.

5. A digital electronic watch according to claim 1; wherein said remaining-time display means includes means settable in a plurality of different timing modes for alternatively displaying when in each timing mode information representative of the time remaining within one of a plurality of different preselected time periods; and wherein said manually-actuated switching means includes a time-setting switch manually movable to a plurality of working positions to respectively select different ones of said timing modes to accordingly select time periods whose remaining time is to be displayed by said remaining-time display means.

6. A digital electronic watch according to claim 5; including time-scale display means for displaying a time scale indicating the duration of the selected time period in response to actuation of said time-setting switch to each said working position.

7. A digital electronic watch according to claim 1; including warning means coacting with said remaining-time display means for providing an audible warning signal in response to the expiration of a predetermined portion of said time period.

8. A digital electronic watch according to claim 1; wherein said remaining-time display means comprises a divider circuit receptive of said timing pulse signal for dividing same into a plurality of time signals each representative of a different duration time period, a remaining-time display section having a series of energizeable display elements each operative when energized to provide a shining output, and electric circuit means settable in a plurality of different timing modes and receptive of said plurality of time signals for alternatively effecting when in each timing mode sequential energization of said display elements at predetermined time intervals in dependence upon one of said time signals to collectively provide a visible indication in digital form of the time remaining within the selected time period; wherein said manually-actuated switching means includes a time-setting switch manually movable to a plurality of working positions to respectively set the desired timing mode in said electric circuit means; and including time-scale display means for automatically displaying a time scale which indicates the duration of the selected time period in response to movement of said time-setting switch to any of said working positions.

9. A digital electronic watch according to claim 8; wherein said energizeable display elements comprise liquid crystal panels disposed in a column and individually energizeable into shining state by said electric circuit means; and wherein said time-scale display means comprises one display section disposed adjacent the first liquid crystal panel to be sequentially energized and having means for displaying in digital form the duration of the time period selected by said time-setting switch, and another display section disposed adjacent the last liquid crystal panel to be sequentially energized and having means for displaying in digital form that zero time remains within the selected time period.

10. A digital electronic watch according to claim 1; wherein said remaining-time display means comprises a divider circuit receptive of said timing pulse signal for dividing same into a plurality of time signals each representative of a different duration time period, a remaining-time display section having a series of energizeable display elements each operative when energized to provide a shining output, circuit means for effecting simultaneous energization of all said display elements in response to switching ON said remaining-time display means, the electric circuit means settable in a plurality of different timing modes and receptive of said plurality of time signals for alternatively effecting when in each timing mode sequential deenergization of said display elements to thereby cause them to provide nonshining outputs at predetermined time intervals in dependence upon one of said time signals to collectively provide a visible indication in digital form of the time remaining within the selected time period; wherein said manually-actuated switching means includes a time-setting switch manually movable to a plurality of working positions to respectively set the desired timing mode in said electric circuit means; and including time-scale display means for automatically displaying a time scale which indicates the duration of the selected time period in response to movement of said time-setting switch to any of said working positions.

11. A digital electronic watch according to claim 10; wherein said energizeable display elements comprise liquid crystal panels disposed in a column and simultaneously energizeable into shining state by said first-mentioned circuit means; and wherein said time-scale display means comprises one display section disposed adjacent the first liquid crystal panel to be sequentially deenergized and having means for displaying in digital form the duration of the time period selected by said time-setting switch, and another display section disposed adjacent the last liquid crystal panel to be sequentially deenergized and having means for displaying in digital form that zero time remains within the selected time period.

12. In a digital electronic watch: means for generating an electric timing pulse signal having a sufficient pulse repetition rate to be used as a time reference; solid-state time display means receptive of and responsive to said electric timing pulse signal for displaying the time in minutes and hours in digital form; and solid-state remaining-time display means receptive of and responsive to said electric timing pulse signal for displaying information representative of the time remaining within at least one preselected time period, said remaining-time display means including a series of energizeable panel members each operative when energized to provide a distinguishable output, and means for energizing said series of panel members to sequentially distinguish them according to discrete time elapses of said preselected time period.

13. A digital electronic watch according to claim 12; including manually-actuated switching means coacting with said solid-state remaining-time display means for manually switching ON said remaining-time display means to initiate the running of said time period.

* * * * *